US007119281B2

(12) United States Patent
Sato et al.

(10) Patent No.: US 7,119,281 B2
(45) Date of Patent: Oct. 10, 2006

(54) TERMINAL END PROCESSING METHOD AND TERMINAL END SHIELDING STRUCTURE OF SHIELDED CABLE, AND LIGHT TRANSMITTING/RECEIVING SYSTEM USING TERMINAL END SHIELDING STRUCTURE

(75) Inventors: Yoshihide Sato, Ashigarakami-gun (JP); Hisayoshi Mori, Ashigarakami-gun (JP); Kazuhiro Sakai, Ashigarakami-gun (JP); Tsutomu Hamada, Ashigarakami-gun (JP); Masaru Kijima, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/124,057

(22) Filed: May 9, 2005

(65) Prior Publication Data

US 2006/0090921 A1 May 4, 2006

(30) Foreign Application Priority Data

Nov. 1, 2004 (JP) ..... 2004-318430

(51) Int. Cl.
*H01R 9/05* (2006.01)

(52) U.S. Cl. ..... 174/75 C

(58) Field of Classification Search ..... 174/75 C, 174/78; 439/98, 610
See application file for complete search history.

(56) References Cited

U.S. PATENT DOCUMENTS

| | | | | |
|---|---|---|---|---|
| 4,886,464 | A * | 12/1989 | Zetena, Jr. | 439/98 |
| 5,231,249 | A * | 7/1993 | Kimura et al. | 174/105 SC |
| 6,107,572 | A * | 8/2000 | Miyazaki | 174/75 C |
| 6,354,878 | B1 * | 3/2002 | Kropa et al. | 439/610 |
| 6,386,919 | B1 * | 5/2002 | Medina et al. | 439/610 |
| 6,540,531 | B1 * | 4/2003 | Syed et al. | 439/98 |
| 6,688,896 | B1 * | 2/2004 | Matsumoto | 439/98 |

FOREIGN PATENT DOCUMENTS

JP 2-129873 * 5/1990

* cited by examiner

*Primary Examiner*—Chau N. Nguyen
(74) *Attorney, Agent, or Firm*—Oliff & Berridge, PLC

(57) ABSTRACT

A terminal end shielding method of a shielded cable, including the steps of: forming a first electrically-conductive thin film, which is elastic, on a peripheral surface of an outer skin end portion at a shielded cable terminal end portion at which a shielding member is exposed by a predetermined length from the outer skin end portion of a free end side; bending the shielding member and making the shielding member contact the electrically-conductive thin film; forming a second electrically-conductive thin film, which is elastic, on the shielding member which contacts the electrically-conductive thin film; and pressing and fixing a portion at which the second electrically-conductive thin film is formed, by a shielded cable nipping means.

12 Claims, 6 Drawing Sheets

TERMINAL END PROCESSING METHOD AND TERMINAL END SHIELDING STRUCTURE OF SHIELDED CABLE, AND LIGHT TRANSMITTING/RECEIVING SYSTEM USING TERMINAL END SHIELDING STRUCTURE

CROSS-REFERENCE TO RELATED APPLICATION

This application claims priority under 35 USC 119 from Japanese Patent Application No. 2004-318430, the disclosure of which is incorporated by reference herein.

BACKGROUND OF THE INVENTION

1. Field of the Invention

The present invention relates to a terminal end processing method and a terminal end shielding structure of a shielded cable at a terminal end portion of a shield braid (shield layer), which shielded cable is used in transferring high-speed signals between electronic equipment, and to a light transmitting/receiving system using a terminal end shielding structure.

2. Description of the Related Art

In recent years, shielded cables, in which a bundle of core wires are covered by a net-like shielding member, have been used in order to reduce the unneeded radiation of electromagnetic waves at the time of carrying out high-speed signal transfer of from several tens of MHz to several GHz between electronic equipment.

In this shielded cable, a net-like end portion of the shielding member electrically contacts and is fixed to a metal, electrically-conductive case which is formed for electromagnetic shielding of electronic equipment. In this way, there can be obtained good effects of decreasing influence of the electromagnetic waves and reducing unneeded radiation.

For example, the following is proposed as a terminal end shielding structure of a conventional shielded cable: a supporting ring, which is formed in the shape of a hollow cylindrical tube, is placed on a shielding layer which is non-tin-plated. The shielding layer is folded back at the peripheral edge of the supporting ring, and an earthing wire also is made to contact the outer peripheral wall of the supporting ring. An electrically-conductive tube, which is formed in the shape of a hollow cylinder, is placed on the earthing wire and the shielding layer on the outer peripheral wall of the supporting ring. The terminal end shielding structure is crimped and fixed by applying a uniform pressure to the outer peripheral wall of the electrically-conductive tube from the outer side (see, for example, Japanese Patent Application Laid-Open (JP-A) No. 2001-286025).

As another terminal end shielding structure of a shielded cable, a ferrite compound layer is interposed between a shield braid and an electric insulating layer at the terminal end portion of a shielded cable. A toroidal core is attached to a separated portion of an insulating covering layer at the terminal end of the cable. The distal end portion of a shielding layer is folded back so as to cover the outer side of the toroidal core. An insulating cable is wound around the outer surface thereof. The distal end portion of the shielding layer is connected to a shielding metal cover, and forms a coil of one turn (see, for example, JP-A No. 2004-31291).

As yet another terminal end shielding structure of a shielded cable, there is proposed a structure in which the shield braid of a shielded cable is pressure-contacted and fixed by a clamp portion of an electrically-conductive inner side case, and is pressure-contacted and fixed also by a clamp portion of an electrically-conductive outer side case. In this way, a member of the outer side case member and the inner side case are reliably connected electrically, the mechanical strength of a fit-together portion is reinforced, and the electrical connection can be made stable (see, for example, JP-A No. 2002-117937).

In the above-described terminal end shielding structures of a shielded cable, during the work of folding-back the shield braid toward the outer skin at the end portion of the shielded cable, it is easy for the free end portion of the shield braid to be scattered and become unevenly distributed. Further, the gaps between the plural core wires which are wrapped by the shield braid collapse easily. It is therefore difficult for the cross-section of the end portion to be a stable circular configuration.

In the above-described conventional terminal end shielding structures of a shielded cable, when the braiding wires of the shield braid are disjoined and are folded back toward the outer skin, as described above, it is easy for the plural braiding wires to be distributed unevenly and randomly. Accordingly, the places of contact with the electrically-conductive member for shielding, which is disposed to as to envelop the outer peripheral surfaces thereof, are dispersed.

As a result, there are relatively few portions of contact with the case, and the impedance at the portions of electrical connection between the shield braid and an electrically-conductive tape is high. Therefore, when transferring high-speed signals of from several tens of MHz to several GHz, there is the problem that the effects of the countermeasures to EMI (electromagnetic interference) are insufficient.

Thus, in the above-described conventional shielding structures of a shielded cable, it has been thought to wind an electrically-conductive adhesive tape in order to gather together the respective wires which have been dispersed and increase the portions of electrical contact at the free end portions of the braiding wires of the shield braid.

However, in this case, the adhesive surface of the electrically-conductive adhesive tape abuts the outer peripheral surfaces of the free end portions of the braiding wires of the shield braid, and the contact resistance is great. Therefore, it is difficult to achieve an electrical connection at a low impedance. At the time of carrying out high-speed signal transfer of from several tens of MHz to several GHz, there is the problem that the effects of the countermeasures to EMI (electromagnetic interference) are insufficient.

In the case of a structure of nipping the portion at which portion the electrically-conductive adhesive tape is wound on the braiding wire free end portions of the shield braid as described above, by an electrically-conductive case for shielding which is divided into two parts and to be put together, there is dispersion in the thickness of the shield braid which is dispersed, and there is the possibility of insufficient contact at the restrained portion. Accordingly, when transferring high-speed signals of from several tens of MHz to several GHz, there is the problem that the effects of the countermeasures to EMI (electromagnetic interference) are insufficient.

In particular, in the case of a structure in which electrical continuity is achieved by nipping the free end portions of the braiding wires of the shield braid by an electrically-conductive case for shielding which is divided in two, if the configurations of the nip-in portions of these two cases form a diamond-shaped space for nipping by the combination of two triangular shapes, there are four points of contact. Accordingly, there is dispersion in the states of contact at the pressed-down portions.

In such a contact state, when high-speed signal transfer of from several tens of MHz to several GHz is carried out in order to stabilize the electrical connection, there is the problem that the effects of the countermeasures to EMI (electromagnetic interference) are insufficient.

SUMMARY OF THE INVENTION

In view of the above-described problems, the present invention newly provides a terminal end processing method and terminal end shielding structure of a shielded cable, and a light transmitting/receiving system using a terminal end shielding structure, which, between a net-like end portion of a shielding member at a shielded cable and a connecting portion of a member for electromagnetic shielding of electronic equipment, and by carrying out electrical connection while maintaining a stable state of contact with a low impedance, (1) are difficult to be affected by electromagnetic waves from the exterior, and (2) reduce unneeded radiation from the interior, and provide a sufficient countermeasure effect to EMI (electromagnetic interference) even when carrying out high-speed signal transfer of from several tens of MHz to several GHz.

In a first aspect of the present invention, a terminal end shielding method of a shielded cable includes the steps of: forming a first electrically-conductive thin film, which is elastic, on a peripheral surface of an outer skin end portion at a shielded cable terminal end portion at which a shielding member is exposed by a predetermined length from the outer skin end portion of a free end side; bending the shielding member and making the shielding member contact the electrically-conductive thin film; forming a second electrically-conductive thin film, which is elastic, on the shielding member which contacts the electrically-conductive thin film; and pressing and fixing a portion at which the second electrically-conductive thin film is formed, by a shielded cable nipping means.

In accordance with the above-described terminal end processing method of a shielded cable, the folded-back shielding member is in a state of being nipped-in, between the first electrically-conductive thin film (electrically-conductive tape) and the second electrically-conductive thin film (outer side electrically-conductive tape), on the outer peripheral surface of the outer skin end portion. Further, the nipped portion of the shielding member between the electrically-conductive tape and the outer side electrically-conductive tape, is nipped so as to be elastically deformed by nipping concave portions, and is made to electrically contact the shield lead-out portion.

In this way, the shielding member can ensure state of stable electrical contact with respect to the electrically-conductive tape and the outer side electrically-conductive tape. Further, a low-impedance electrical connection to the shield lead-out portion from the shield portion, which is nipped-in between the electrically-conductive tape and the outer side electrically-conductive tape, can be realized. Therefore, it is possible to form a shielding structure which is difficult to be affected by electromagnetic waves from the exterior, and which reduces unneeded radiation from the interior.

Namely, in accordance with the present aspect, terminal end processing of a shielded cable, which can obtain a sufficient countermeasure effect to EMI (electromagnetic interference), can be carried out easily.

In a second aspect of the present invention, the first and second electrically-conductive thin films of the above-described first aspect are electrically-conductive tapes.

In accordance with the present aspect, the shielding member can ensure state of stable electrical contact with respect to the electrically-conductive tape and the outer side electrically-conductive tape. Further, a shielding structure is realized which provides a low-impedance electrical connection to the shield lead-out portion from the shield portion which is nipped-in between the electrically-conductive tape and the outer side electrically-conductive tape, and which is difficult to be affected by electromagnetic waves from the exterior, and which reduces unneeded radiation from the interior. In this way, terminal end processing of a shielded cable, which can obtain a sufficient countermeasure effect to EMI (electromagnetic interference), can be carried out easily.

In a third aspect of the present invention, the second electrically-conductive thin film of the above-described first aspect is a copper tape.

In a fourth aspect of the present invention, a terminal end shielding structure of a shielded cable has: a first electrically-conductive thin film which is elastic and which is formed on a peripheral surface of an outer skin end portion of a free end side of a shielded cable; a shielding member contacting the first electrically-conductive thin film; a second electrically-conductive thin film which is elastic and which is formed on the shielding member; and shielded cable nipping means for pressing and fixing a portion at which the second electrically-conductive thin film is formed.

In a fifth aspect of the present invention, the first and second electrically-conductive thin films of the above-described fourth aspect are electrically-conductive tapes.

In a sixth aspect of the present invention, the second electrically-conductive thin film of the above-described fourth aspect is a copper tape.

In a seventh aspect of the present invention, the first electrically-conductive thin film of the above-described sixth aspect is wound one time or more on the peripheral surface of the outer skin end portion, and at least an end portion of the second electrically-conductive tape and a surface of the first electrically-conductive tape are electrically continuous.

In an eighth aspect of the present invention, the shielded cable nipping means of the above-described fourth aspect is formed from a nipping portion having a pair of concave portions, and a sectional area of the portion at which the second electrically-conductive film is formed is greater than or equal to a sectional area of an opening formed by the concave portions of the nipping portion being put together.

In a ninth aspect of the present invention, a configuration of the opening formed by the concave portions of the nipping portion of the above-described eighth aspect being put together is one of substantially oval and substantially diamond-shaped.

A tenth aspect of the present invention is a signal transferring system including: a first signal transmitting/receiving module to which is connected a first shielded cable which transfers electric signals from an exterior; a second signal transmitting/receiving module to which is connected a second shielded cable which transfers electric signals from an exterior; and a signal transfer medium transferring signals between the first signal transmitting/receiving module and the second signal transmitting/receiving module, wherein a terminal end shielding structure of at least one of the first shielded cable and the second shielded cable has: a first electrically-conductive thin film which is elastic and which is formed on a peripheral surface of an outer skin end portion of a free end side of a shielded cable; a shielding member contacting the first electrically-conductive thin film; a second electrically-conductive thin film which is elastic and which is formed on the shielding member; and shielded cable nipping means for pressing and fixing a portion at which the second electrically-conductive thin film is formed, and the shielded cable nipping means is a portion of a case of the first and second signal transmitting/receiving modules.

In accordance with the present aspect, the shielding member can ensure state of stable electrical contact with respect to the first electrically-conductive thin film (the electrically-conductive tape) and the second electrically-conductive thin film (the outer side electrically-conductive tape). Further, a low-impedance electrical connection to the shield lead-out portion from the shield portion, which is nipped-in between the electrically-conductive tape and the outer side electrically-conductive tape, is possible.

In this way, the electrical circuits within the first transmitting/receiving module and the second transmitting/receiving module can be made to be shielding structures which are difficult to be affected by electromagnetic waves from the exterior, and which reduce unneeded radiation from the electrical circuits at the interior. Accordingly, a light transmitting/receiving system, which has a sufficient countermeasure effect to EMI (electromagnetic interference), can be obtained.

Namely, in accordance with the terminal end processing method and terminal end shielding structure of a shielded cable and the light transmitting/receiving system using a terminal end shielding structure of the present invention, the net-like end portion of the shielding member at the shielded cable and the connecting portion of the member for electromagnetic shielding of the electronic equipment, are electrically connected while a stable state of contact at a low impedance is ensured.

In this way, according to the present invention, there are achieved good effects that the terminal shield structure is less susceptible to electromagnetic waves from the exterior, unneeded radiation from the interior is reduced, and a sufficient countermeasure effect to EMI (electromagnetic interference) can be obtained even in cases of carrying out high-speed signal transfer of from several tens of MHz to several GHz.

In an eleventh aspect of the present invention, the first signal transmitting/receiving module of the above-described tenth aspect converts at least a portion of the electric signals transferred from the exterior into optical signals, and the signal medium transfers the optical signals generated at the first signal transmitting/receiving module, and the second signal transmitting/receiving module converts at least a portion of the optical signals into electrical signals, and transfers the electric signals to the exterior.

DETAILED DESCRIPTION OF THE INVENTION

An embodiment relating to a light transmitting/receiving system, which is structured by using a terminal end processing method and terminal end shielding structure of a shielded cable of the present invention, will be described with reference to FIGS. 1 through 10.

(Overall Structure)

Figure 1:
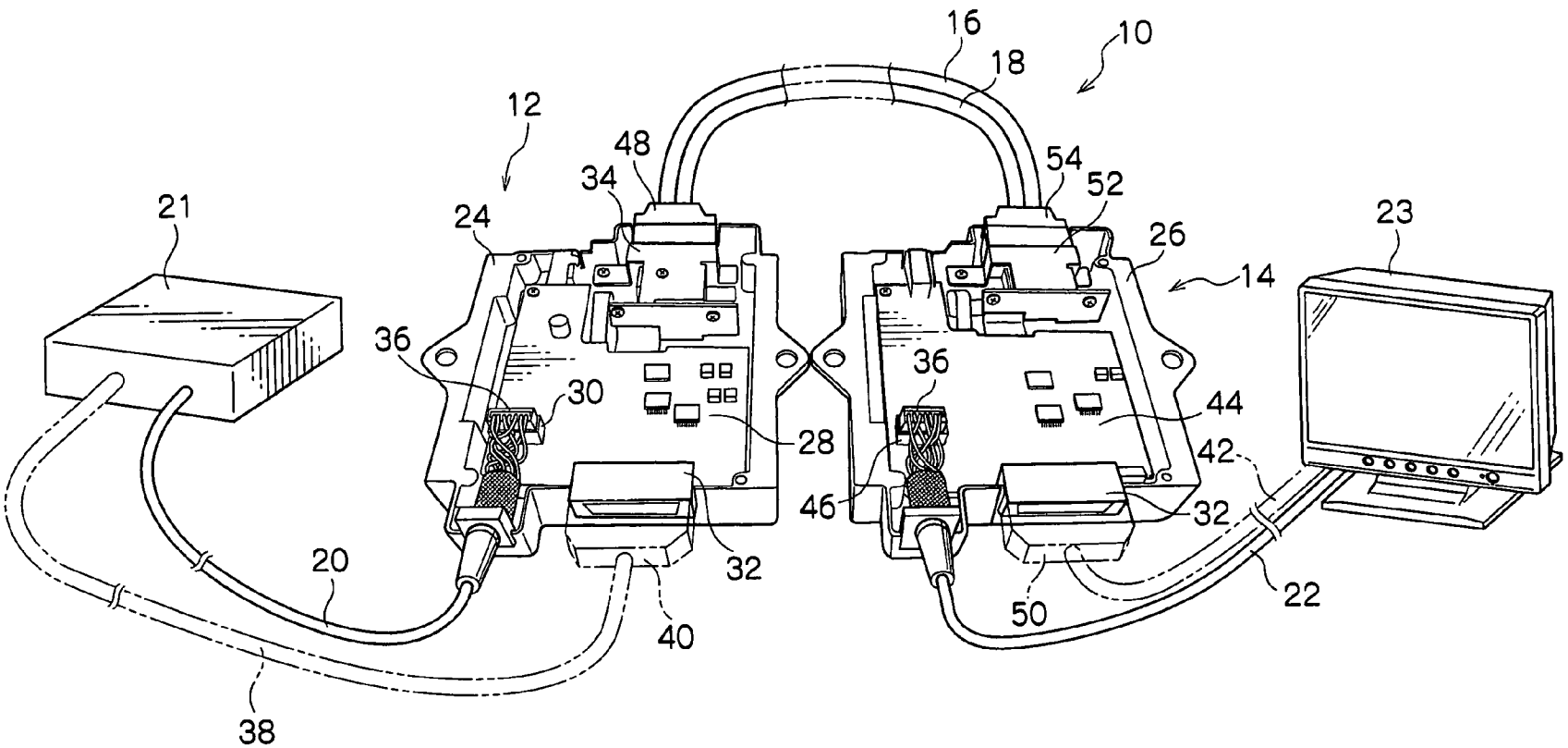
FIG. 1 is a perspective view relating to an embodiment relating to a terminal end processing method and terminal end shielding structure of a shielded cable and a light transmitting/receiving system using a terminal end shielding structure of the present invention, and showing a state in which the light transmitting/receiving system is used in connecting a host computer and a monitor, and showing the interior with covers removed.
Figure 2:
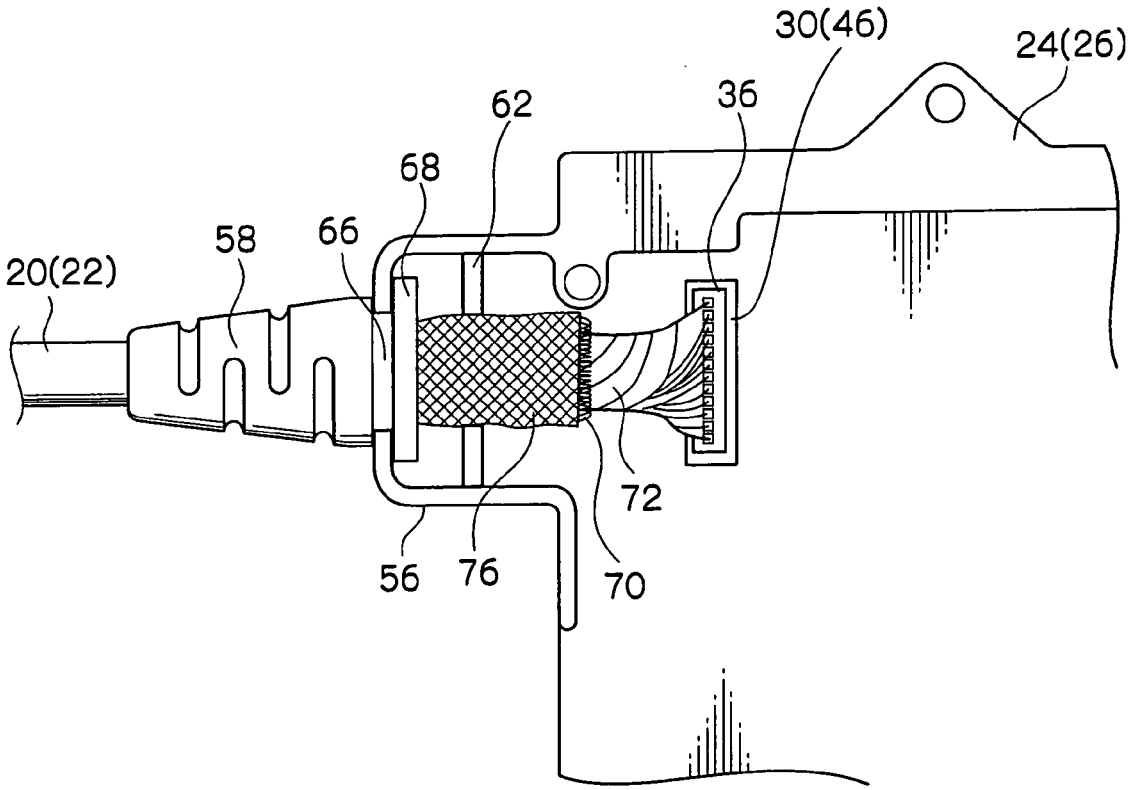
FIG. 2 is a plan view of a terminal end shielding structure portion of a shielded cable in each transmitting/receiving module of the light transmitting/receiving system relating to the embodiment of the present invention.

As shown in FIG. 1, a light transmitting/receiving system 10 relating to the present embodiment can be used in, for example, transmitting high-frequency video signals, control signals, and audio signals from a host computer 21 to a large monitor 23 which is set at a place which is separated, by 10 m or more, from the host computer 21, and in transferring control signals from the monitor 23 to the host computer 21.

The light transmitting/receiving system (light transferring device) 10 has a first transmitting/receiving module 12 which transmits high-speed optical signals and receives low-speed optical signals, a second transmitting/receiving module 14 which receives high-speed optical signals and transmits low-speed optical signals, and an optical fiber cable 16 for high-speed optical signals and an optical fiber cable 18 for low-speed optical signals which connect the first transmitting/receiving module 12 and the second transmitting/receiving module 14.

Although not illustrated, an external power source is connected to each of the first transmitting/receiving module 12 and the second transmitting/receiving module 14, and electric power is supplied thereto from the exterior.

For connecting the host computer 21 and the first transmitting/receiving module 12 of the light transmitting/receiving system 10, the light transmitting/receiving system 10 has a shielded cable 20 which is a video signal cable, and an electrical cable 38 which transfers control signals and audio signals. Further, for connecting the monitor 23 and the second transmitting/receiving module 14 of the light transmitting/receiving system 10, the light transmitting/receiving system 10 has a video signal cable 22 which is a shielded cable, and an electrical cable 42 which transfers control signals and audio signals.

(Structure of First Transmitting/Receiving Module)

The first transmitting/receiving module 12 at the light transmitting/receiving system 10 is structured by using a box-shaped case 24 which has the same configuration as that of a case 26 of the second transmitting/receiving module 14 which will be described later. The cases 24, 26 and covers (not shown) are molded integrally by zinc die casting, respectively.

A circuit board 28 is disposed within the case 24. The circuit board 28 has an electricity-light converting circuit which converts the video signals, the control signals and the audio signals, which are electric signals, into high-speed optical signals and transmits the high-speed optical signals, and a light-electricity converting circuit which converts received low-speed optical signals into the control signals which are electric signals.

A female electric connector 30, to which the video signals which are electric signals are inputted, and a female connector 32, which transmits the control signals and the audio signals which are electric signals, are provided at one end portion of the circuit board 28. For example, a male electric connector 36 of the shielded cable 20, which is connected to a video signal generating device such as the personal computer 21 or the like and transfers video signals and the like, is connected to the female electric connector 30 for video signal transfer. A male connector 40 of the electric cable 38, which is for transmitting and receiving control signals to and from the personal computer 21 or the like and for transmitting audio signals, is connected to the female connector 32.

A receptacle 34 is provided at the other end portion of the circuit board 28. Although not illustrated, a module for high-speed optical signal transmission and a module for reception of low-speed optical signals are disposed at the receptacle 34. The module for high-speed optical signal transmission has, at the interior thereof, a light-generating element which outputs optical signals for transmitting high-speed optical signals. The module for reception of low-speed optical signals has a light-receiving element which receives low-speed optical signals and outputs electric signals.

(Structure of Second Transmitting/Receiving Module)

A circuit board 44 is disposed within the case 26 of the second transmitting/receiving module 14 in the light transmitting/receiving system 10. The circuit board 44 has a light-electricity converting circuit which converts received high-speed optical signals into the video signals, the control signals and the audio signals, which are electric signals, and transmits the electric signals, and an electricity-light converting circuit which converts the control signals which are electric signals into low-speed optical signals and transmits the low-speed optical signals.

A female electric connector 46, which outputs the video signals which are electric signals, and the female connector 32, which transmits and receives the control signals and the audio signals which are electric signals, are provided at one end portion of the circuit board 44. For example, the male electric connector 36 of the shielded cable 20, which transfers video signals and the like to the monitor 23 or the like, is connected to the female electric connector 46 for video signal transfer. A male connector 50 of the electric cable 42, which transmits audio signals and control signals such as remote control signals and state signals and the like of the monitor 23, is connected to the female connector 32.

A receptacle 52 is provided at the other end portion of the circuit board 44. Although not illustrated, a module for high-speed optical signal reception and a module for transmission of low-speed optical signals are disposed at the receptacle 52. The module for high-speed optical signal reception has, at the interior thereof, a light-receiving element (e.g., a photodiode) which receives high-speed optical signals and outputs electric signals. The module for transmission of low-speed optical signals has a light-generating element which outputs optical signals, in order to transmit low-speed optical signals.

The optical fiber cable 16 for high-speed optical signals and the optical fiber cable 18 for low-speed optical signals, which connect the first transmitting/receiving module 12 and the second transmitting/receiving module 14 which are structured as described above, are formed in an integral linear form. The optical fiber cable 16 and the optical fiber cable 18 have, at the end portions thereof, an optical connector 48, which is connected to the receptacle 34 of the first transmitting/receiving module 12, and an optical connector 54, which is connected to the receptacle 52 of the second transmitting/receiving module 14.

(Structures Relating to Terminal End Processing of Shielded Cable)

Next, description will be given of: a means which, between the case 24 and the shielded cable 20 that is connected to and led-out from the female electric connector 30 of the first transmitting/receiving module 12 in the light transmitting/receiving system which is structured as described above, carries out terminal end processing of a shield braid (shield layer) in order to electrically connect and fix the case 24 and the shielded cable 20, to reduce unneeded radiation and the influence of electromagnetic waves; and a means which carries out terminal end processing of a shield braid (shield layer) between the case 26 and the video signal cable 22 which is connected to and led-out from the female electric connector 46 of the second transmitting/receiving module 14.

Figure 10:
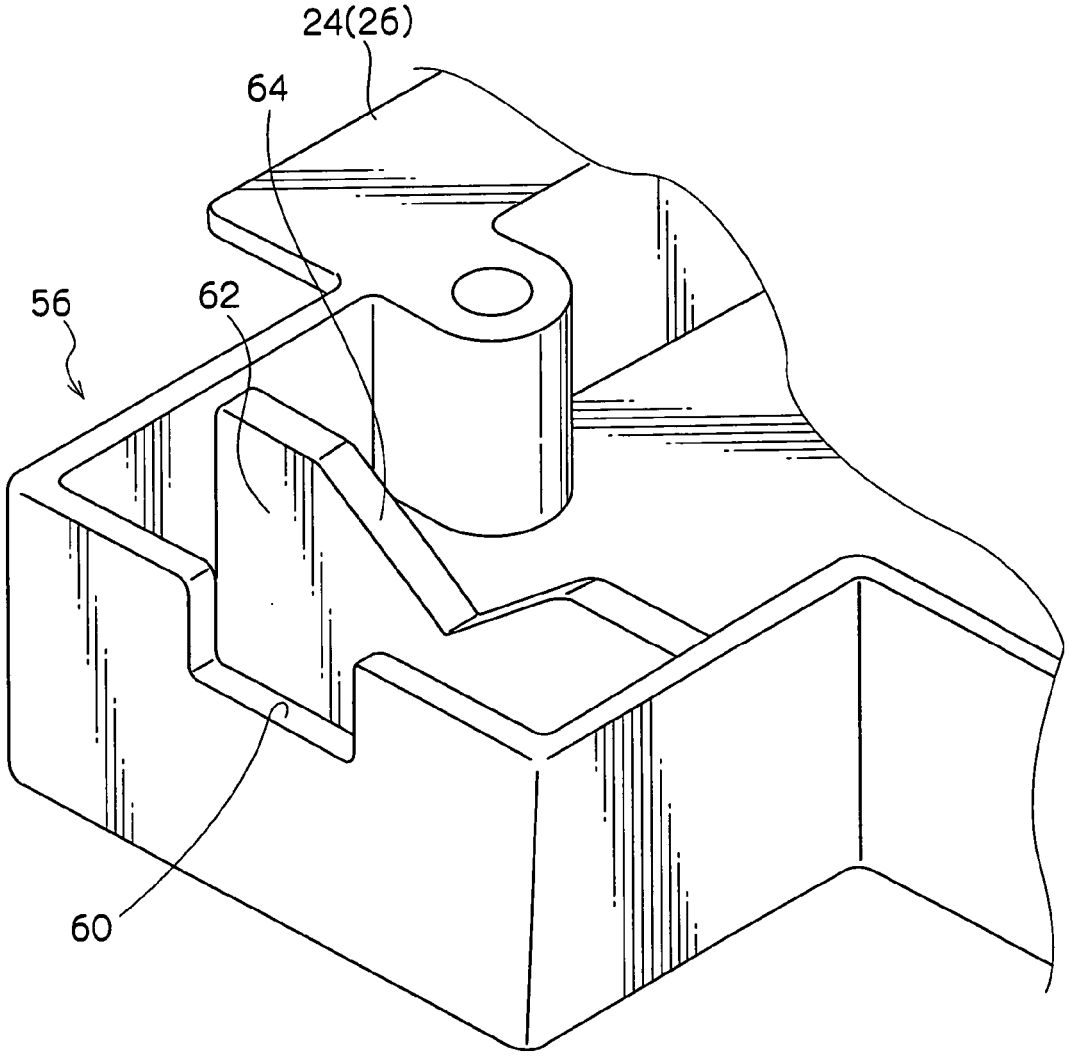
FIG. 10 is a perspective view of main portions, showing a shield lead-out portion provided at a case, of the terminal end shielding structure portion of the shielded cable used in the light transmitting/receiving system relating to the embodiment of the present invention.

In order to carry out terminal end processing of the shield braids (shield layers) at the shielded cables 20, 22 which serve as video signal cables, a shield lead-out portion 56, which is a connector case and has an electrically contacting and fixing structure such as shown as an example in FIG. 10, is provided at each of the cases 24, 26.

The shield lead-out portion 56 is structured so as to project out substantially in the shape of a rectangular box without a cover, from the case 24, 26. An engaging portion 60 is formed in the distal end surface of the shield lead-out portion 56. The engaging portion 60 is shaped as a U-shaped groove by a portion being cut-out rectangularly from the shield lead-out portion 56, such that the engaging portion 60 is fit to a fit-together concave portion formed in a bush 58 provided at the end portion of the shielded cable 20, 22 and the shield cable (20, 22) is unable to be pulled out and inserted in the shield lead-out portion 56.

A partitioning wall 62, which functions to cause electrical contact, is disposed in the shield lead-out portion 56 at a position which is inward from the distal end surface of the shield lead-out portion 56 by a predetermined distance, so as to be parallel to the distal end surface.

A nipping concave portion 64, which is for nipping and which press-contacts an electrically continuous portion corresponding to the shield braid of the shielded cable 20, 22, is formed in the center of the open edge portion of the partitioning wall 62.

At the first transmitting/receiving module 12 and the second transmitting/receiving module 14, by attaching the corresponding covers (not shown) to the cases 24, 26 respectively, the electromagnetically shielded cases, which are electromagnetically closed, of the first transmitting/receiving module 12 and the second transmitting/receiving module 14 are structured.

Therefore, a shield lead-out portion, which is structured so as to have mirror symmetry with respect to the above-described shield lead-out portion 56, is provided at each of the covers (not shown). The engaging portion 60, which is provided at the shield lead-out portion 56 of the case 24, 26, and an engaging portion, which is provided in the cover (not shown) and is formed in the shape of a U-shaped groove by being cut-out rectangularly, correspond to one another and form a rectangular opening.

The nipping concave portion 64, which is provided in the partitioning wall 62 of the shield lead-out portion 56 of the case 24, 26, and a nipping concave portion, which is provided at the cover (not shown in FIG. 10), correspond to one another and form an opening of a predetermined configuration. The configuration of the opening, which is formed by the nipping concave portion 64 provided at the partitioning wall 62 and the nipping concave portion formed at the cover coinciding therewith, may be any of various types of opening configurations such as, for example, the diamond shape which is shown in FIG. 8 and which is formed by the nipping concave portion 64 provided at the partitioning wall 62 being put together with the nipping concave portion of the cover, the oval shape shown in FIG. 9, circular, a configuration in which a single or plural projections extend in the central direction of the opening, or the like.

Figure 8:
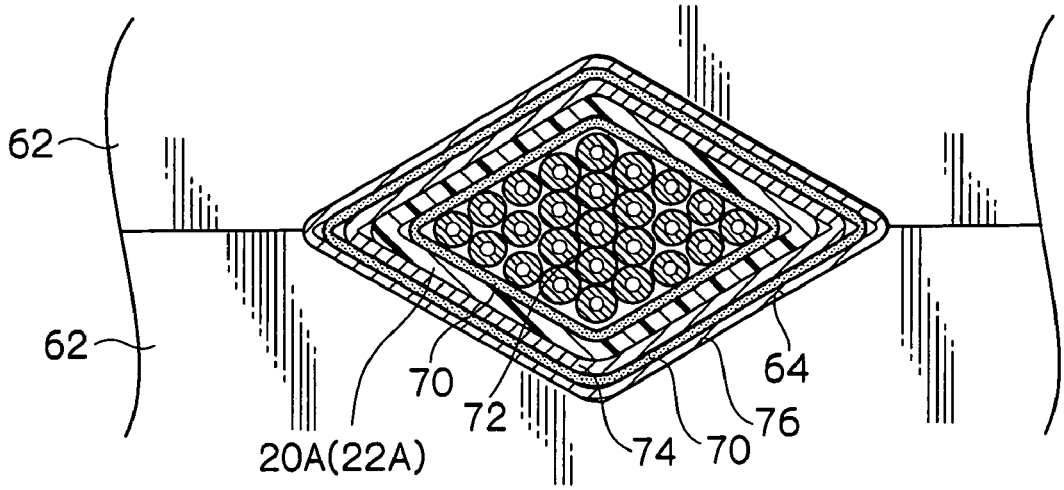
FIG. 8 is a sectional view of main portions, showing the terminal end shielding structure portion of the shielded cable used in the light transmitting/receiving system relating to the embodiment of the present invention, with the shielding structure portion nipped in nipping concave portions which form a diamond shape overall.
Figure 9:
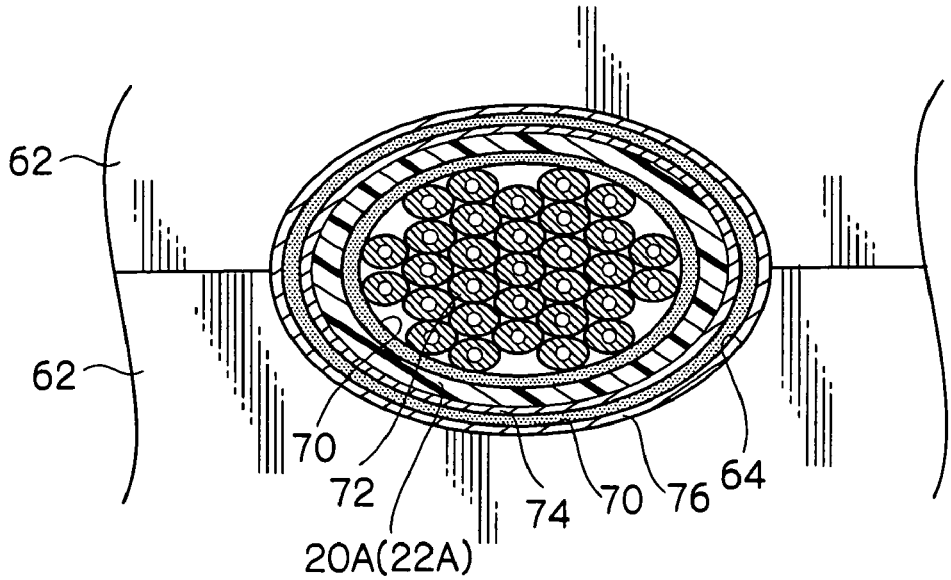
FIG. 9 is a sectional view of main portions, showing the terminal end shielding structure portion of the shielded cable used in the light transmitting/receiving system relating to the embodiment of the present invention, with the shielding structure portion nipped in nipping concave portions which form an oval overall.

When the opening formed by putting together the nipping concave portion 64 provided in the partitioning wall 62 and the nipping concave portion of the cover is the diamond shape shown in FIG. 8, there is a connected state in which the electrically continuous portion corresponding to the shield braid of the shielded cable 20, 22 is strongly pressed down by the central portions of the four sides. Further, when the opening formed by putting together the nipping concave portion 64 provided in the partitioning wall 62 and the nipping concave portion of the cover is the oval shape shown in FIG. 9, there is a connected state in which the electrically continuous portion corresponding to the shield braid of the shielded cable 20, 22 is strongly pressed down by at least two portions.

The terminal end processing means at the terminal end portion of the shielded cable 20, 22, which is mounted to the shield lead-out portion 56 which is structured as described above, will be described next.

Figure 3:
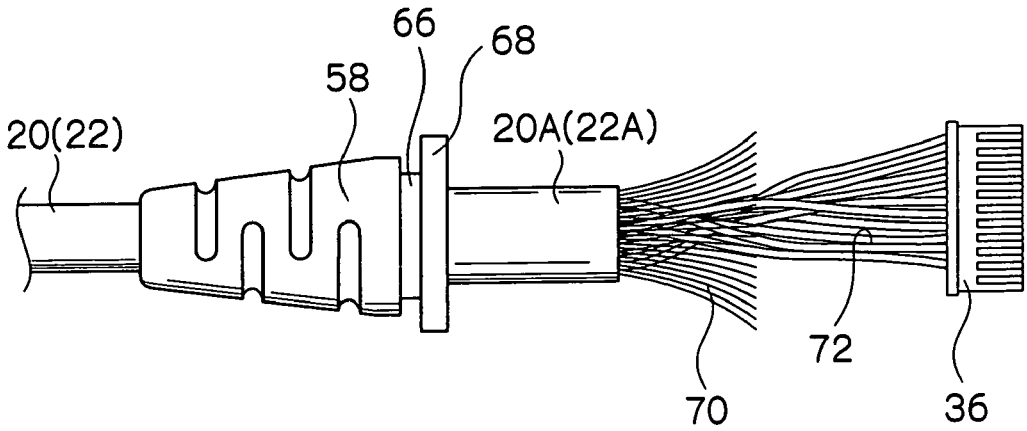
FIG. 3 is a plan view showing a state before terminal end processing of a terminal end portion of the shielded cable used in the light transmitting/receiving system relating to the embodiment of the present invention.

As shown in FIG. 3, the bush 58 is provided at the terminal end portion of the shielded cable 20, 22, which terminal end portion is to be connected to the shield lead-out portion 56. A fit-together concave portion 66, which is a ring-shaped, shallow groove, is formed in the bush 58, and a bush portion 68 is formed at the free end side thereof.

An outer skin end portion 20A, 22A extends out by a corresponding predetermined length so as to be made to press-contact the engaging concave portion 64 from the bush 58 to the free end side, at the terminal end portion of the shielded cable 20, 22 which is to be connected to the shield lead-out portion 56.

At the terminal end portion of the shielded cable 20, 22 which is to be connected to the shield lead-out portion 56, a shielding member 70, which is a shield braid (shield layer), extends-out from the outer skin end portion 20A, 22A by a length which is slightly shorter than the length of extension of the outer skin end portion 20A, 22A. The outer skin end portion 20A, 22A is removed over a predetermined range so as to expose a predetermined length of the shielding member 70, accordingly.

The male electrical connector 36 is attached to the distal end of a bundle 72 of plural core wires which are disposed so as to be wrapped at the inner side of the shielding member 70. Note that the operation of working the material of the shielded cable 20, 22, which has been readied in advance and has been subjected to the workings described above, is carried out in the terminal end processing means at the shielded cable 20, 22.

Figure 4:
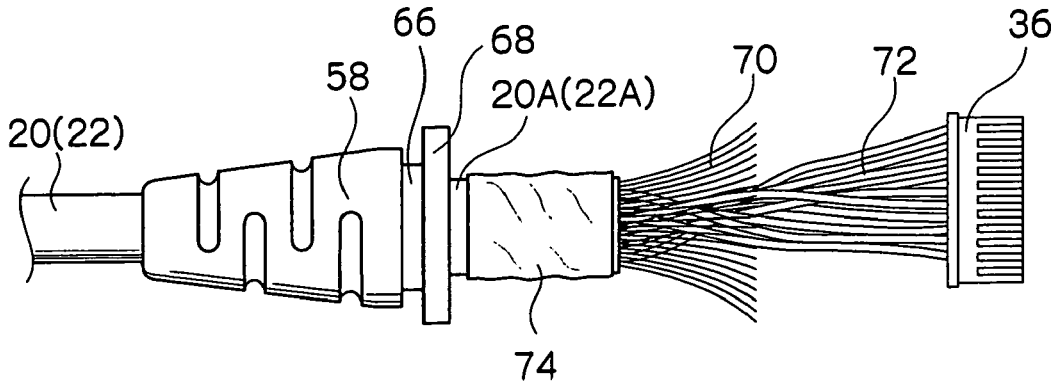
FIG. 4 is a plan view showing a process of winding an electrically-conductive tape on an outer skin end portion of the terminal end portion of the shielded cable used in the light transmitting/receiving system relating to the embodiment of the present invention.

Next, as the first work process of the terminal end processing means at the shielded cable 20, 22, as shown in FIG. 4, an electrically-conductive tape 74, which is a flexible copper tape, is wound at least one time around the outer peripheral surface of the outer skin end portion 20A, 22A. A tape at which an adhesive is applied at the reverse side thereof is used as this electrically-conductive tape 74.

However, in the state in which the electrically-conductive tape 74 is wound one time continuously around the outer peripheral surface of the outer skin end portion 20A, 22A, at least the wound end portion which appears at the outer peripheral surface is electrically connected at a low impedance to the surface of the electrically-conductive tape 74 therebeneath, so that the entire peripheral surface is the same potential. Therefore, at the electrically-conductive tape 74, for example, the adhesive in the vicinity of the end portion which appears at the outer peripheral surface at which the electrically-conductive tape 74 is wound, is removed, and the end portion of the electrically-conductive tape 74 and the surface midway along the electrically-conductive tape 74 directly contact one another.

Note that the electrically-conductive tape 74 is not necessarily wound one time or more around the outer peripheral surface of the outer skin end portion 20A, 22A. That is, as long as the shielding member 70 can be set in a state of being electrically connected at a low impedance, it is acceptable to wind the electrically-conductive tape 74 such that there is a gap between the both end portions thereof.

Figure 5:
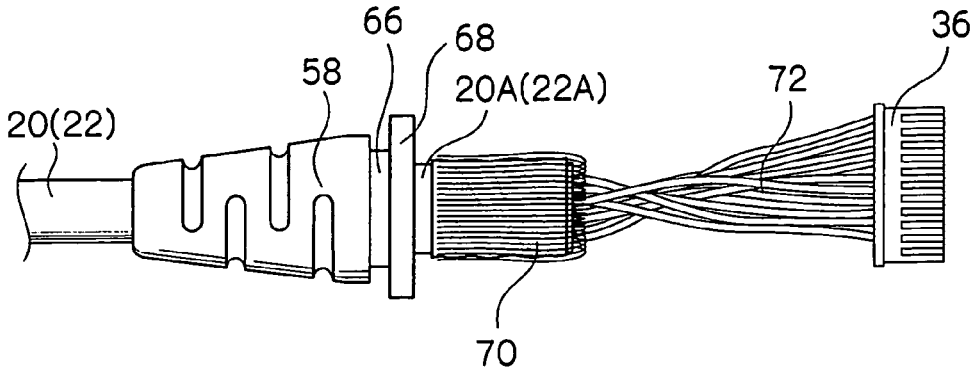
FIG. 5 is a plan view showing a process of folding back and superposing a shielding member on the electrically-conductive tape which is wound on the outer skin end portion at the terminal end portion of the shielded cable used in the light transmitting/receiving system relating to the embodiment of the present invention.

Next, as the second work process of the terminal end processing means at the shielded cable 20, 22, as shown in FIG. 5, the shielding member 70, which is in a state in which the shield braid is unbound, is folded over and superposed on the outer peripheral surface of the electrically-conductive tape 74 which is wound on the outer skin end portion 20A, 22A. In this terminal end processing means, the plural thin wires of the shielding member 70, which are in an unbound state, are dispersed uniformly on the outer peripheral surface of the shielding member 70 so that a stable electrical connection is achieved.

Figure 6:
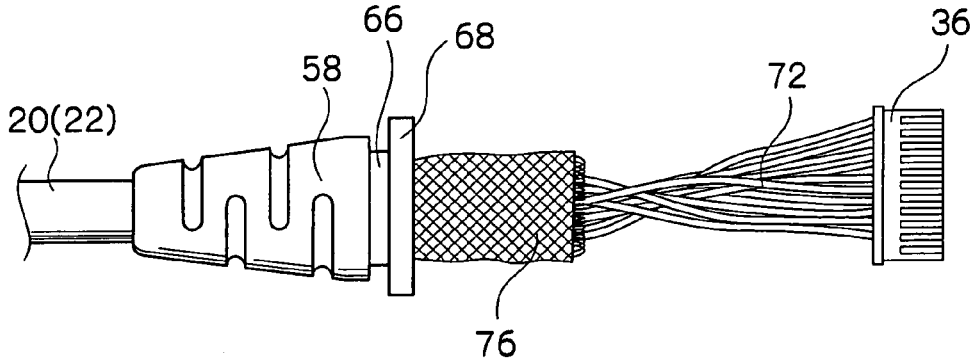
FIG. 6 is a plan view showing a process of superposing the shielding member on the electrically-conductive tape which is wound on the outer skin end portion at the terminal end portion of the shielded cable used in the light transmitting/receiving system relating to the embodiment of the present invention, and winding an outer side electrically-conductive tape thereon.
Figure 7:
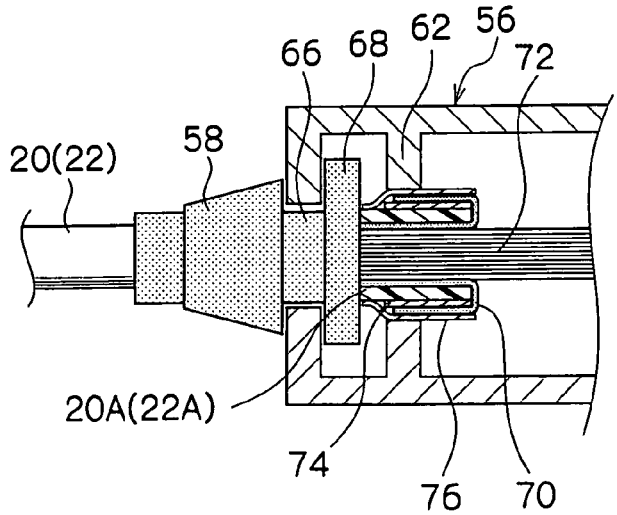
FIG. 7 is a sectional view showing a terminal end shielding structure portion of the shielded cable used in the light transmitting/receiving system relating to the embodiment of the present invention.

Subsequently, as the third work process of the terminal end processing means at the shielded cable 20, 22, as shown in FIG. 6, in order to fix the fine wires of the shielding member 70, an outer side electrically-conductive tape 76, which is an electrically-conductive cloth tape, is wound one time or more around the shielding member 70 which has been folded back.

Note that the outer side electrically-conductive tape 76 is not necessarily wound one time or more from the outer side of the shielding member 70. That is, as long as the shielding member 70 can be set in a state of being electrically connected at a low impedance, it is acceptable to wind the outer side electrically-conductive tape 76 such that there is a gap between the both end portions thereof.

A tape, which is structured so as to be flexible and which appropriately fits when wound on the shielding member 70 which has many recesses and protrusions, is used as the outer side electrically-conductive tape 76. It is preferable to reliably obtain a shielding effect by using a tape at which an electrically-conductive adhesive is applied on the reverse side thereof, as the outer side electrically-conductive tape 76. For example, the electrically-conductive cloth tape TR-25 manufactured by Takeuchi Kogyo Co., Ltd. can be used as the outer side electrically-conductive tape 76.

By winding a predetermined amount of the outer side electrically-conductive tape 76 on the shielding member 70 which has been folded back, the sectional area to the outer peripheral surface of the wound outer side electrically-conductive tape 76 is greater than or equal to the sectional area of the opening formed by putting the pair of upper and lower nipping concave portions 64 together.

When the portion of the shielded cable 20, 22, on which portion is wound the outer side electrically-conductive tape 76 and which portion is structured as the terminal end processing means, is nipped so as to be press-contacted by the pair of upper and lower nipping concave portions 64 in the subsequent work process. At this time, the portion on which the outer side electrically-conductive tape 76 is wound is crushed as if elastically deformed, and is set in a state of being press-contacted by the inner portion of the opening which is structured by the pair of upper and lower nipping concave portions 64. By setting this portion in the state of being strongly pressed down at the central portions of the four sides of the inner peripheral surface of the diamond-shaped opening structured by the pair of upper and lower nipping concave portions 64 as shown in FIG. 8, this portion electrically contacts at a low impedance, and the shielded cable 20, 22 can be shielded so as to be electromagnetically stable at the portion thereof passing through the shield lead-out portion 56.

The above-described electrically-conductive tape 74 and outer side electrically-conductive tape 76 are structured such that there is electric continuity at the superposed portion even though an adhesive is applied. Moreover, in a case in which the electrically-conductive tape 74 and the outer side electrically-conductive tape 76 do not overlap one another when wound, it is acceptable if the surface at which the adhesive is applied is provided with no electrical continuity.

Namely, in accordance with the terminal end shielding structure of the shielded cable relating to the present embodiment, the electrically-conductive tape 74, which is a copper tape, is placed between the outer skin end portion 20A, 22A and the shielding member 70 which is a shield braid.

In other words, when the shield braid of the shielding member 70 is folded back on the outer skin end portion 20A, 22A, by providing the electrically-conductive tape 74, which serves as the base layer, on the outer skin end portion 20A, 22A, a contact portion which is electrically stable can be ensured over the range at which the electrically-conductive tape 74 is wound at the shielding member 70 which has been disjoined.

Due to this structure, a state of electrical connection at a lower impedance can be realized between the shield braids of the folded-back shielding member 70.

Moreover, in this terminal end shielding structure of a shielded cable, the outer side electrically-conductive tape 76 is wound around from on the shielding member 70, and the shielding member 70 thus wrapped with the tape 76 is nipped-in at the nipping concave portion 64 portion provided at the shield lead-out portion 56 of the case 24, 26. It is thereby possible to ensure states of good electrical connection at stable places of contact.

In such a structure, by winding the electrically-conductive tape 76 on the outer side of the shielding member 70, the contact between the shielding member 70 and the partitioning wall 62 via the electrically-conductive tape can be realized by a connecting structure having a lower impedance.

Further, at the end portions of the shielded cables 20 and 22, the electrically-conductive tapes 74 are wound on the outer skin end portions 20A and 22A, the shielding members 70 are folded-back thereon, and the outer side electrically-conductive tapes 76 are wound thereon. By nipping the portions, which are structured in this way, by making these portions contact the nipping concave portions 64 of the two shield lead-out portions 56, it is possible to form shielded structures which are completely cut-off from the exterior, at the cases 24 and 26 to which the covers (not shown) are attached.

As a result, electromagnetic waves from the exterior do not affect the internal electrical circuits, and the great effect of reducing unneeded radiation from the internal electrical circuits is achieved.

The results of a test confirming the effects of the terminal end shielding structure of a shielded cable relating to the present embodiment, will be described next.

In this test, a structure in which copper tape is not wound between the outer skin and the shield braid is used as a comparative example. In the structure of the comparative example, at the contact portion of the electrically-conductive tape and the shield braid, the shield braid which has been disjoined is in a state of contacting the electrically-conductive tape locally. Further, a structure, whose contact resistance is high due to the adhesive of the electrically-conductive tape, is nipped by and contacted the nipping concave portion of the case. Therefore, electrical contact is achieved only at the connection points which are actually pressed down, and the dispersion of the contact state is satisfactory.

In this test, it is confirmed that the terminal end shielding structure of a shielded cable relating to the present embodiment stabilizes and improves, by about 10 dB, the radiation level of radiated electromagnetic waves, as compared with the comparative example.

(Operation)

Operation of the light transmitting/receiving system using the terminal end shield structure of a shielded cable relating to the present embodiment will be described next.

A high-frequency video signal is transferred from the host computer 21 by the shielded cable 20. A control signal and an audio signal (electric signals) are transferred from the host computer 21 by the electric cable 38. These signals are inputted to the first transmitting/receiving module 12 in the light transmitting/receiving system.

When the control signal and the audio signal are inputted to the first transmitting/receiving module, the video signal as well as the control signal and audio signal are each converted into a single optical signal at the electricity-light converting circuit of the circuit board 28. The optical signals are transmitted to the second transmitting/receiving module 14 via the optical fiber cable 16 for high-speed optical signals.

At this time, with regard to high-frequency video signal which is transferred through the shielded cable 20, the shielded cable 20 is stably electromagnetically shielded by the terminal end shielding structure at the shield lead-out portion 56. Accordingly, noise can be prevented from entering into the video signal (optical signal) outputted from the first transmitting/receiving module 12.

Further, at the second transmitting/receiving module 14 to which are inputted the optical signals from the first transmitting/receiving module 12 (the high-frequency video signal, control signal, and audio signal), the inputted optical signals (the high-frequency video signal, control signal, and audio signal) are converted into electric signals at the light-electricity converting circuit of the circuit board 44, and become the high-frequency video signal, control signal, and audio signal (electric signals). These signals are transferred to the monitor 23 by the video signal cable 22 and the electric cable 42.

At this time, the video signal cable 22 is stably electromagnetically shielded by the terminal end shielding structure at the shield lead-out portion 56. Therefore, with regard to the video signal which is transferred through the video signal cable 22 which is a shielded cable, it is possible to prevent noise from being inputted to the video signal (electric signal) which is outputted from the second transmitting/receiving module 14 to the monitor 23.

Further, because the video signal cable 22 which is a shielded cable is stably electromagnetically shielded by the terminal end shielding structure at the shield lead-out portion 56, it is possible to prevent noise which is outputted from the second transmitting/receiving module 14 to the exterior.

Accordingly, the high-frequency video signal, control signal, and audio signal (electric signals) can be transferred with low noise from the host computer 21 to the monitor 23, via the light transmitting/receiving system which utilizes this terminal end shielding structure. Further, radiation interference noise to the exterior can be prevented.

In this light transmitting/receiving system, when a control signal of a remote control and a control signal relating to the state of the monitor 23, which are outputted from the monitor 23, are inputted to the second transmitting/receiving module 14 by the electric cable 42, these control signals are converted into optical signals at the electricity-light converting circuit of the circuit board 44. The optical signals are transmitted to the first transmitting/receiving module 12 via the optical fiber cable 18 for low-speed optical signals.

At the first transmitting/receiving module 12 to which the optical signal (video signal) is inputted from the second transmitting/receiving module 14, the inputted optical signal (video signal) is converted into an electric signal at the light-electricity converting circuit of the circuit board 44. The electric signal is transferred to the host computer 21 by the electrical cable 38.

Note that the present invention is not limited to the above-described embodiment, and can assume any of various structures within a scope which does not deviate from the gist of the present invention.

What is claimed is:

1. A terminal end shielding method of a shielded cable, comprising:

providing a first electrically-conductive tape as a first electrically-conductive thin film, which is elastic, on a peripheral surface of an outer skin end portion at a shielded cable terminal end portion at which a shielding member is exposed by a predetermined length from the outer skin end portion of a free end side;

bending the shielding member and making the shielding member contact the first electrically-conductive thin film;

providing a second electrically-conductive tape as a second electrically-conductive thin film, which is elastic and is a separate body from the first electrically-conductive tape, on the shielding member which contacts the first electrically-conductive thin film;

winding the first electrically-conductive thin film one time or more on the peripheral surface of the outer skin end portion, wherein at least an end portion of the second electrically-conductive thin film and a surface of the first electrically-conductive thin film are in physical contact and electrically continuous; and pressing and fixing a portion at which the second electrically-conductive thin film is formed, by a shielded cable nipping means.

2. The terminal end shielding method of a shielded cable of claim 1, wherein the second electrically-conductive tape is made of a different material than the first electrically-conductive tape.

3. The terminal end shielding method of a shielded cable of claim 1, wherein the second electrically-conductive thin film is a copper tape.

4. A terminal end shielding structure of a shielded cable, comprising:

a first electrically-conductive tape as a first electrically-conductive thin film which is elastic and which is formed on a peripheral surface of an outer skin end portion of a free end side of a shielded cable;

a shielding member folded on the first electrically-conductive thin film such that the shielding member contacts the first electrically-conductive thin film, the shielding member having no cut portion at the folded end thereof;

a second electrically-conductive tape as a second electrically-conductive thin film which is elastic and is a separate body from the first electrically-conductive tape, the second electrically-conductive thin film being formed on the shielding member; and shielded cable nipping means for pressing and fixing a portion at which the second electrically-conductive thin film is formed, wherein the first electrically-conductive thin film is wound one time or more on the peripheral surface of the outer skin end portion, and at least an end portion of the second electrically-conductive thin film and a surface of the first electrically-conductive thin film are in physical contact and electrically continuous.

5. The terminal end shielding structure of a shielded cable of claim 4, wherein the second electrically-conductive tape is made of a different material than the first electrically-conductive tape.

6. The terminal end shielding structure of a shielded cable of claim 5, wherein an adhesive applied to a reverse side of the second electrically-conductive thin film is electrically-conductive.

7. The terminal end shielding structure of a shielded cable of claim 4, wherein the second electrically-conductive thin film is a copper tape.

8. The terminal end shielding structure of a shielded cable of claim 4, wherein the shielded cable nipping means is formed from a nipping portion having a pair of concave portions, and a sectional surface area of the portion at which the second electrically-conductive film is formed is greater than or equal to a surface area of an opening formed by the concave portions of the nipping portion being put together.

9. The terminal end shielding structure of a shielded cable of claim 8, wherein a configuration of the opening formed by the concave portions of the nipping portion being put together is one of substantially oval and substantially diamond-shaped.

10. A signal transferring system comprising:

a first signal transmitting/receiving module to which is connected a first shielded cable which transfers electric signals from an exterior;

a second signal transmitting/receiving module to which is connected a second shielded cable which transfers electric signals from an exterior; and a signal transfer medium transferring signals between the first signal transmitting/receiving module and the second signal transmitting/receiving module, wherein a terminal end shielding structure of at least one of the first shielded cable and the second shielded cable comprises:

a first electrically-conductive tape as a first electrically-conductive thin film which is elastic and which is formed on a peripheral surface of an outer skin end portion of a free end side of the shielded cable;

a shielding member folded on the first electrically-conductive thin film such that the shielding member contacts the first electrically-conductive thin film, the shielding member having no cut portion at the folded end thereof;

a second electrically-conductive tape as a second electrically-conductive thin film which is elastic and is a separate body from the first electrically-conductive tape, the second electrically-conductive thin film being formed on the shielding member; and shielded cable nipping means for pressing and fixing a portion at which the second electrically-conductive thin film is formed, and the shielded cable nipping means is a portion of a case of the first and second signal transmitting/receiving modules.

11. The signal transferring system of claim 10, wherein the first signal transmitting/receiving module converts at least a portion of the electric signals transferred from the exterior into optical signals, and the signal medium transfers the optical signals generated at the first signal transmitting/receiving module, and the second signal transmitting/receiving module converts at least a portion of the optical signals into electrical signals, and transfers the electric signals to the exterior.

12. The signal transferring system of claim 10, wherein the second electrically-conductive tape is made of a different material than the first electrically-conductive tape.

* * * * *